US006705929B1

(12) United States Patent
Nishimoto et al.

(10) Patent No.: US 6,705,929 B1
(45) Date of Patent: Mar. 16, 2004

(54) CLOTH CLEANING DEVICE AND POLISHING MACHINE

(75) Inventors: Yoshinobu Nishimoto, Nagano (JP); Makoto Nakajima, Nagano (JP); Yoshio Nakamura, Nagano (JP); Yasuhide Denda, Nagano (JP); Chihiro Miyagawa, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 263 days.

(21) Appl. No.: 09/716,398

(22) Filed: Nov. 20, 2000

(30) Foreign Application Priority Data

Nov. 25, 1999 (JP) ..... 11-334631

(51) Int. Cl.[7] ..... B24B 7/00

(52) U.S. Cl. ..... 451/72; 451/56; 451/424; 451/443; 451/283

(58) Field of Search ..... 451/72, 424, 443, 451/283, 287, 56

(56) References Cited

U.S. PATENT DOCUMENTS 5,421,768 A * 6/1995 Fujiwara et al. ..... 451/271
5,578,529 A * 11/1996 Mullins ..... 134/33
5,611,943 A * 3/1997 Cadien et al. ..... 156/345.12
5,626,509 A * 5/1997 Hayashi ..... 451/271
5,857,898 A * 1/1999 Hiyama et al. ..... 451/287
6,238,270 B1 * 5/2001 Robinson ..... 216/89
6,364,752 B1 * 4/2002 Kimura et al. ..... 451/21
6,443,810 B1 * 9/2002 Shih ..... 451/41

* cited by examiner

*Primary Examiner*—Lee D. Wilson
*Assistant Examiner*—Alvin J Grant
(74) *Attorney, Agent, or Firm*—Jordan and Hamburg LLP

(57) ABSTRACT

Cloth cleaning device of a polishing machine which is capable of fully cleaning a polishing cloth including a part in the vicinity of a center roller. The cloth cleaning device includes an arm movable in a plane parallel to the polishing cloth between a first position above the polishing cloth and a second position outside of the polishing cloth. A jet nozzle is attached to the arm and directs high pressure water toward the polishing cloth. An enclosing member encloses the jet nozzle so as to prevent the high pressure water, which has been directed out from the jet nozzle, from scattering. The jet nozzle is oriented toward the center roller and the high pressure water is directed toward the part of the polishing cloth in the vicinity of the center roller when the arm moves the jet nozzle close to the center roller.

20 Claims, 5 Drawing Sheets

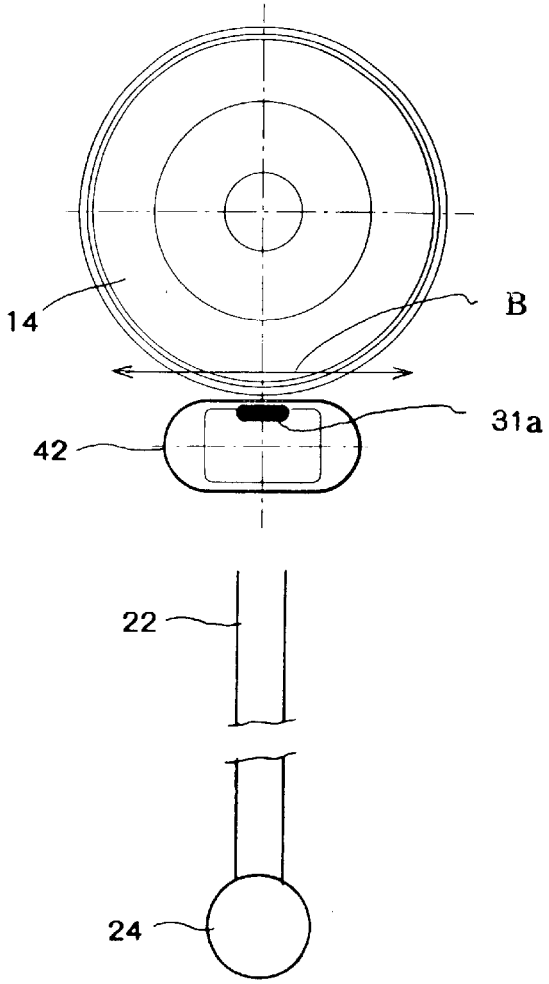
FIG.5
FIG.10
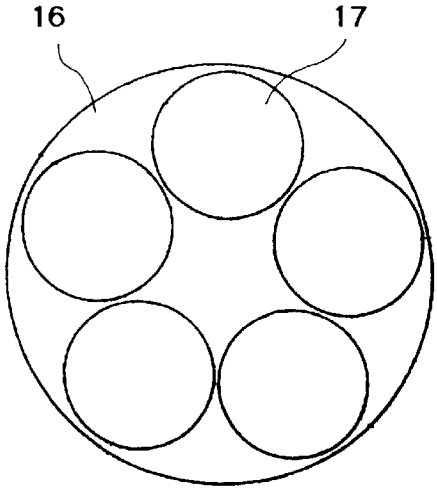

CLOTH CLEANING DEVICE AND POLISHING MACHINE

BACKGROUND OF THE INVENTION

The present invention relates to a cloth cleaning device and a polishing machine including the cloth cleaning device.

A surface of a semiconductor wafer must be precisely polished like a mirror face with uniform thickness before integrated circuits are formed thereon.

Many types of polishing machines have been used to polish semiconductor wafers, etc.

One of the conventional polishing machines is shown in FIGS. 8 and 9. The polishing machine 10 has a polishing plate 12 having an upper face which is covered with a polishing cloth and which is rotated in a horizontal plane. A center roller 14, which is capable of rotating freely, is arranged at a center of the polishing plate 12. A plurality of work plates 16 are arranged on the polishing cloth. Work pieces to be polished, e.g., semiconductor wafers, are adhered to a bottom face of each work plate 16, and their bottom faces contact the polishing cloth.

FIG. 10 shows a state in which the semiconductor wafers 17 are adhered to the work plate 16. Guide rollers 18 are arranged in the vicinity of an outer edge of the polishing plate 12 as shown in FIG. 9, and outer circumferential faces of the work plates 16 contact the center roller 14 and the guide rollers 18. The polishing plate 12 is rotated in a direction of an arrow "A", but the work plates 16 are held at predetermined positions by the center roller 14 and the guide rollers 18.

As shown in FIG. 9, the guide rollers 18 are moved vertically by an elevating mechanism, and their strokes of vertical movement are equal to or more than the thickness of the work plates 16. When the guide rollers 18 are at their lowest positions, they are located close to the outer edge of the polishing plate 12 so as to contact the outer circumferential face of the work plates 16 and when the guide rollers 18 are at their highest positions, they are moved away from the outer edge of the polishing plate 12 so as to allow the work plates 16 to pass through a space between the center roller 14 and the guide rollers 18 with the rotation of the polishing plate 12.

The guide rollers 18 may be moved between positions close to the outer edge of the polishing plate 12 and positions away therefrom by, for example, swinging arms of the guide rollers 18. The moving mechanism of the guide rollers 18 is not always necessary. In some constructions, the guide rollers 18 may be fixed at predetermined positions or no guide rollers 18 are required.

Press heads 20 are moved vertically. When the press heads 20 are at their lowest positions, the press heads 20 respectively press the work plates 16 and the semiconductor wafers onto the polishing cloth with an appropriate force. Therefore, the bottom faces of the semiconductor wafers can be polished by the polishing cloth which is rotated together with the polishing plate 12.

The press heads 20 can be freely rotated about their axes.

While polishing the semiconductor wafers, alkaline slurry including abrasive grains, e.g., silica grains, is fed to the rotating polishing cloth. Therefore, the bottom faces of the semiconductor wafers can be mechanically and chemically polished like mirror faces.

A holding member 23 is arranged on a front end of an arm 22 for enabling the polishing cloth to be cleaned. More specifically, a brush (not shown) for brushing the surface of the polishing cloth is arranged on a bottom face of the holding member 23.

The arm 22 is capable of swinging or rotating about a rotary shaft 24 which is located outside of the polishing plate 12. While the semiconductor wafers are polished, the arm 22 is located outside of the polishing plate 12 and while the polishing cloth is cleaned, the arm 22 is swung, about the rotary shaft, above the polishing plate 12.

To clean the polishing cloth, wash water is directed in a radial direction from the center roller 14 onto the polishing cloth.

The polishing cloth must be cleaned because abraded grains, which are formed by abrading the semiconductor wafers, and reaction products gradually permeate and deposit in the polishing cloth. As a result, the polishing efficiency of the polishing cloth is reduced during the course of its use.

However, in the conventional polishing machine, the polishing cloth is cleaned by merely supplying the wash water from the center roller 14 and brushing. As a result, the polishing cloth cannot be fully cleaned, and the polishing efficiency of the polishing cloth cannot be recovered. Further, the holding member 23 must have a prescribed width, so the holding member 23 must be moved backward from the center roller 14 so as not to collide with the center roller 14 when the arm 22 is swung, so that a part of the polishing cloth in the vicinity of the outer circumferential face of the center roller 14 cannot be cleaned well.

SUMMARY OF THE INVENTION

An object of the present invention is to provide a cloth cleaning device and a polishing machine which are capable of fully cleaning a polishing cloth including a part in the vicinity of a center roller.

To achieve this object, a cloth cleaning device of a polishing machine in accordance with the present invention comprises an arm movable in a plane parallel to a polishing cloth arranged on an upper face of a polishing plate between a first position, above the polishing cloth and a second position outside of the polishing cloth; a jet nozzle attached to the arm and arranged to direct high pressure water toward the polishing cloth; and an enclosing member enclosing the jet nozzle so as to prevent the high pressure water, which has been directed out from the jet nozzle, from scattering. The jet nozzle is headed or oriented toward a center roller arranged at the center of the polishing plate and the high pressure water is directed toward a part of the polishing cloth in the vicinity of the center roller when the arm moves the jet nozzle close to the center roller.

A polishing machine in accordance with the present invention comprises a polishing plate having an upper face covered with a polishing cloth; a driving mechanism for rotating the polishing plate; a center roller arranged at a center of the polishing plate; a work plate arranged on the polishing cloth and to which a work piece to be polished is adhered and whose outer circumferential face contacts an outer circumferential face of the center roller such that the work piece contacts the polishing cloth; a press head for pressing the work plate onto the polishing cloth; a slurry feeding mechanism for feeding slurry to the polishing cloth; an arm movable in a plane parallel to the polishing cloth between a first position above the polishing cloth and a second position outside of the polishing cloth; a jet nozzle attached to the arm and arranged to direct high pressure water toward the polishing cloth; and an enclosing member enclosing the jet nozzle so as to prevent the high pressure water which has been directed out from the jet nozzle, from scattering. The jet nozzle is headed or oriented toward the center roller and the high pressure water is directed toward a part of the polishing cloth in the vicinity of the center roller when the arm moves the jet nozzle close to the center roller.

The polishing machine may further comprise a guide roller arranged in the vicinity of an outer edge of the polishing plate, and an outer circumferential face of the work plate may contact outer circumferential faces of the center roller and the guide roller.

In the present invention, an angle of the jet nozzle may be changed between a first angle, at which the jet nozzle is headed toward the center roller, and a second angle, at which the jet nozzle is vertical with respect to the polishing cloth.

A sectional shape of a jet form of the high pressure water may be longer in the direction of moving the arm.

The enclosing member may be a plastic net enclosing the jet nozzle.

In the cloth cleaning device and the polishing machine of the present invention, the polishing cloth including the part in the vicinity of the center roller can be fully cleaned, so that the work piece can be precisely polished with a higher polishing efficiency and the longevity of the expensive polishing cloth can be increased.

BRIEF DESCRIPTION OF THE DRAWINGS

Embodiments of the present invention will now be described by way of examples and with reference to the accompanying drawings, in which:

FIG. 5 is a schematic view showing a sectional shape of a jet form of high pressure water;

FIG. 10 is a top view of the work plate on which the semiconductor wafers are adhered.

DETAILED DESCRIPTION OF THE PREFERRED EMBODIMENTS

Preferred embodiments of the present invention will now be described in detail with reference to the accompanying drawings.

Figure 8:
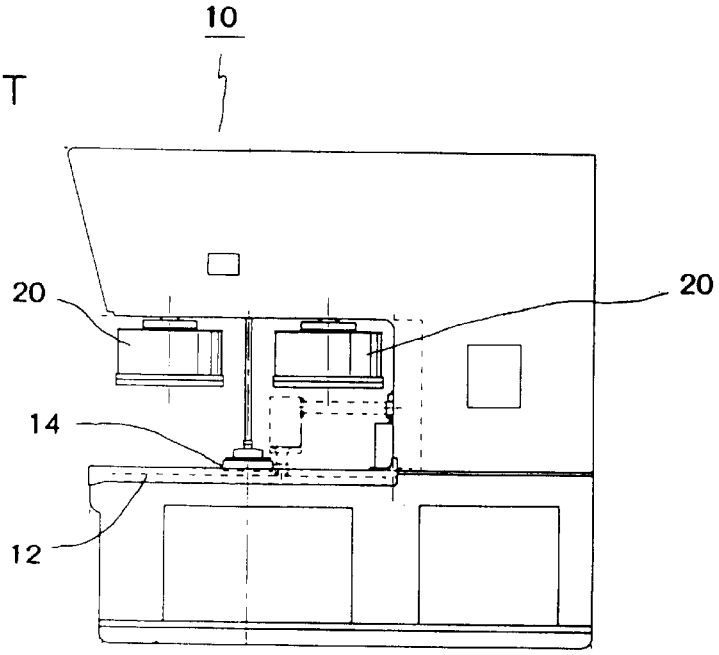
FIG.8 PRIOR ART
FIG. 8 is a schematic view showing the outline of the conventional polishing machine.
Figure 9:
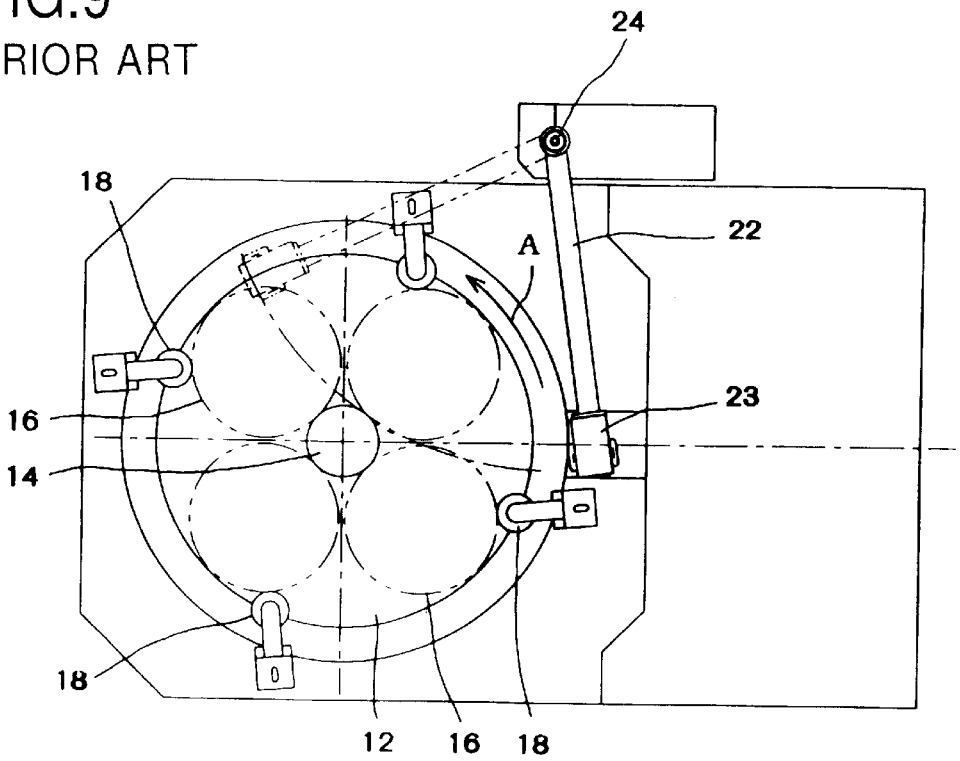
FIG.9 PRIOR ART
FIG. 9 is a plan view of the polishing plate of the conventional polishing machine.

Basic structures of the polishing machines of the present embodiments are substantially the same as those in the conventional polishing machine described above with reference to FIGS. 8–10 and the elements of the present embodiments in common with the conventional polishing machine are assigned the same reference numerals and an explanation thereof will not be repeated in its entirety.

The polishing machine 10 includes the polishing plate 12, whose upper surface is covered with a polishing cloth 12*a*; a driving mechanism (e.g., a motor 33) for rotating the polishing plate 12; the center roller 14 arranged at the center of the polishing plate 12; the work plates 16 arranged on the polishing cloth 12*a* and to each of which work pieces (e.g., semiconductor wafers) to be polished are adhered and whose outer circumferential faces contact the outer circumferential face of the center roller 14 such that the work pieces contact the polishing cloth 12*a*; the press heads 20 for pressing the work plates 16 onto the polishing cloth 12*a*; a slurry feeding mechanism 15 for feeding alkaline slurry to the polishing cloth 12*a*; and a cloth cleaning device 30. The cloth cleaning device 30 comprises an arm 22 rotatable about the rotary shaft 24 in a plane parallel to the polishing cloth 12*a* between a first position above the polishing cloth 12*a* and a second position outside of the polishing cloth 12*a*; a jet nozzle 31 attached to the arm 22 and jetting (directing) high pressure water toward the polishing cloth 12*a*; and an enclosing member 40 enclosing the jet nozzle 31 so as to prevent the high pressure water which has been directed out from the jet nozzle 31 from scattering. The jet nozzle 31 is headed or oriented toward the center roller 14, and the high pressure water is directed toward a part of the polishing cloth 12*a* in the vicinity of the center roller 14 when the arm 12 moves the jet nozzle 31 close to the center roller 14.

The polishing machine in accordance with one embodiment of the invention thus comprises the polishing plate 12, whose upper surface is covered with the polishing cloth 12*a*; the driving mechanism 33 for rotating the polishing plate 12; the center roller 14 arranged at the center of the polishing plate 12; the work plates 16 arranged on the polishing cloth 12*a* and to each of which the work pieces are adhered and whose outer circumferential faces contact the outer circumferential face of the center roller 14 such that the work pieces contact the polishing cloth 12*a*; the press heads 20 for pressing the work plates 16 onto the polishing cloth 12*a*; the slurry feeding mechanism 15 for feeding slurry to the polishing cloth 12*a*; the arm 22 rotatable about the rotary shaft 24 in a plane parallel to the polishing cloth 12*a* between the first position above the polishing cloth 12*a* and a second position outside of the polishing cloth 12; the jet nozzle 31 attached to the arm 22 and directing high pressure water toward the polishing cloth 12*a*; and the enclosing member 40 enclosing the jet nozzle 31 so as to prevent the high pressure water from scattering. The jet nozzle 31 is headed or oriented toward the center roller 14, and the high pressure water is directed toward a part of the polishing cloth 12*a* in the vicinity of the center roller 14 when the arm 12 moves the jet nozzle 31 close to the center roller 14.

In each of the examples, the guide rollers 18 are arranged in the vicinity of the outer edge of the polishing plate 12, and the outer circumferential faces of the work plates 16 contact the center roller 14 and the guide rollers 18.

As described above, characteristic features of the present invention are the cloth cleaning device 30 and the polishing machine including the cloth cleaning means.

Figure 1:
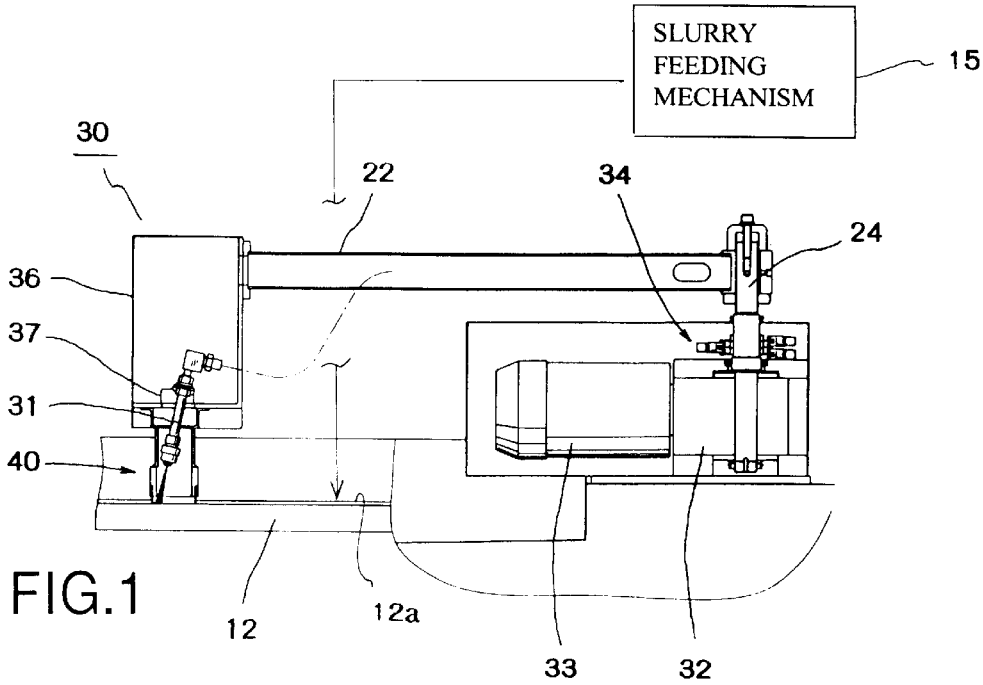
FIG. 1 is a schematic view of a first embodiment of the cloth cleaning device of the present invention.

FIG. 1 shows the arm 22 and the jet nozzle 31 of the cloth cleaning device 30 a first embodiment of the invention.

A base end of the arm 22 is fixed to the rotary shaft 24, and the arm 22 is swung or rotated in the plane parallel to the polishing cloth 12*a*. In this manner, a front end of the arm 22 can be moved between the first position above the polishing plate 12 and the second position outside thereof.

The rotary shaft 24 is rotated by the motor 33, which includes a reduction unit 32.

A sensor 34 detects rotational angle of the rotary shaft 24, so that rotational angle of the arm 22 can be determined.

A holder box 36 is fixed to the front end of the arm 22. The jet nozzle 31 is diagonally pierced through the holder box 36 and fixed to the holder box 36 by a fixing member 37.

A cylindrical hood 38 covers a side of the jet nozzle 31 and is fixed to a bottom face of the holder box 36. Further, the enclosing member 40 is fixed to the hood 38 and encloses sides of the water jet of the high pressure water and prevents the high pressure water from scattering.

The enclosing member 40 includes a cylindrical holding member 41 fixed to a lower end of the hood 38 and cylindrical plastic nets 42 fixed to the holding member 41. Each of the plastic nets is formed, for example, like a screen.

Figure 3:
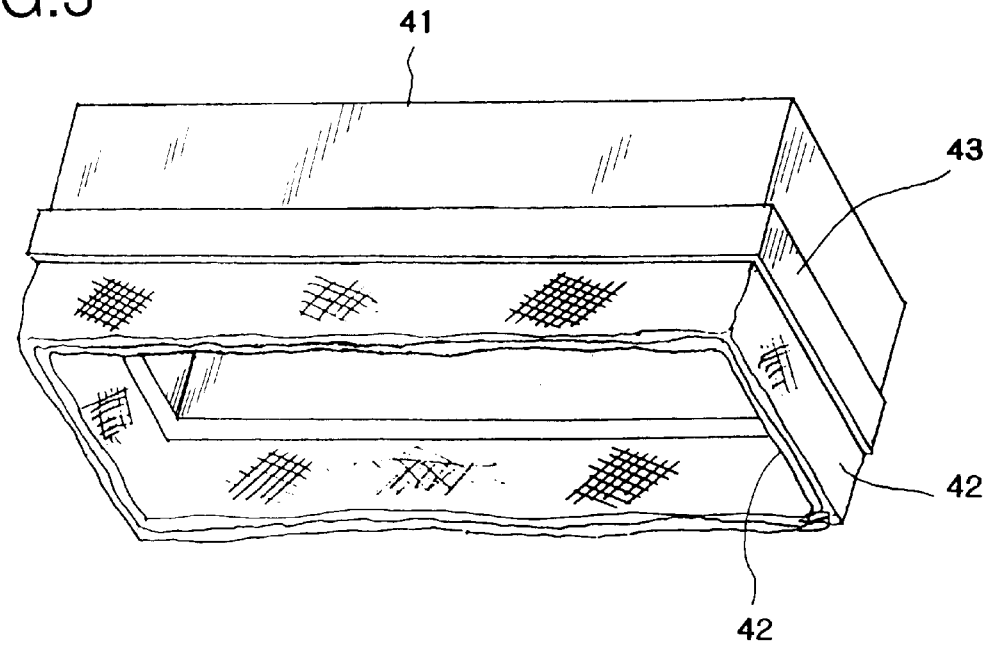
FIG. 3 is a perspective view of a plastic net, which acts as an enclosing member.
Figure 4:
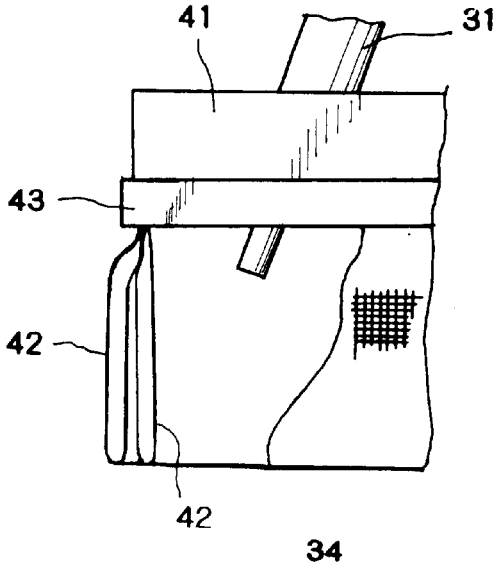
FIG. 4 is a schematic view of the plastic net.

In the first embodiment, as shown in FIGS. 3 and 4, a pair of the plastic nets 42, each of which is folded such that a folding line makes a lower edge, are placed one against the other to form a pile of plastic nets 42. The piled plastic nets 42 are sandwiched and fixed, by bolts (not shown), between the holding member 41 and a frame-shaped member 43. In this manner, the plastic nets 42 constitute a four-net-structure.

The mesh size of each plastic net 42 is about 1 mm, and thickness thereof is 0.5 mm. Therefore, the plastic nets 42, which constitute the four-net-structure, have enough flexibility.

The mesh size and hardness of the plastic nets 42 may be optionally designed. Further, the plastic nets 42 are not limited to the four-net-structure, so other structures (e.g., two-net-structure, six-net-structure) may be employed.

The jet nozzle 31 is arranged diagonally. More specifically, a lower end of the jet nozzle 31 is directed toward the center roller 14 when the arm 22 is located on a line connecting the rotary shaft 24 and the center roller 14, so that the high pressure water, which is diagonally directed out from the jet nozzle 31, can be directed toward the polishing cloth 12*a* in the vicinity of the outer edge of the center roller.

Figure 2:
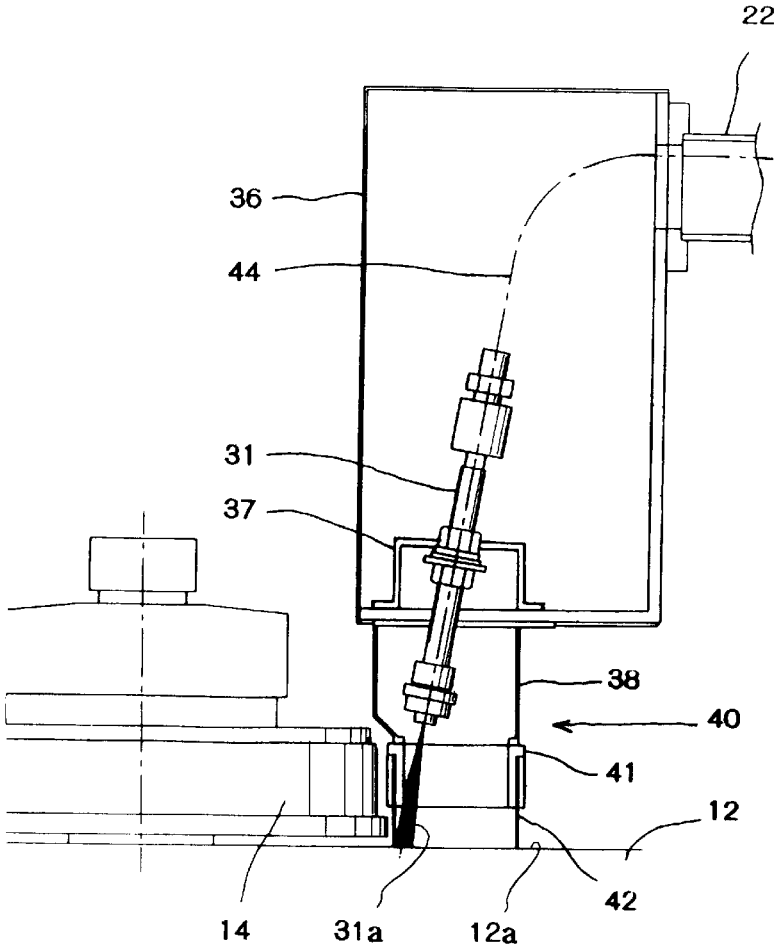
FIG. 2 is an enlarged view in the vicinity of a jet nozzle.

As clearly shown in FIG. 2, when the arm 22 is located at this position, the plastic nets 42 are very close to the outer circumferential face of the center roller 14 and the high pressure water 31*a* is directed toward the lower end of an inner face of the plastic nets 42, which is on the side of the center roller 14. In the first embodiment, the jetted water 31*a* reaches a position 7 mm away from the outer edge of the center roller 14.

The high pressure water is supplied to the jet nozzle 31 via a pressure-resisting hose 44. The pressure of the high pressure water (e.g., 30 kg/cm$^2$ (2.94 Mpa) or more) may be optionally set.

The operation of the polishing machine will now be explained.

When the polishing cloth 12*a* is cleaned, the guide rollers 18 are moved upward and the arm 22 is swung by the motor 33. The rotational angle of the arm 22 is detected by the sensor 34, which detects the rotational angle of the rotary shaft 24, so that the swing movement of the arm 22 can be controlled so as not to move the jet nozzle 31 away from the polishing cloth 12*a*.

A pump (not shown) is driven to supply the high pressure water, and the high pressure water 31*a* is directed from the jet nozzle 31 toward the polishing cloth 12*a*, so that abraded grains and reaction products, which have been deposited in the polishing cloth 12*a*, are washed away by the high pressure water 31*a*. The water including the grains and the reaction products is introduced onto the polishing cloth 12*a* via meshes of the plastic nets 42 and a gap between the lower ends of the plastic nets 42 and the polishing cloth 12*a*. Further, the grains and the reaction products are introduced outside of the polishing cloth 12*a* by water, which is radially directed out from the center roller 14. In this manner, the grains and the reaction products, which have been deposited in the polishing cloth 12*a*, can be removed from the polishing cloth 12*a*, so that the polishing cloth 12*a* can be recovered and reused with high polishing efficiency.

Since the plastic nets 42 have the four-net-structure, the pressure of the high pressure water 31*a* is decreased and the water 31*a* is discharged together with the reaction products, etc., so that the water 31*a* including the reaction products, etc., cannot be scattered to the periphery The periphery can thus be kept clean.

As described above, the structure of the plastic nets 42 is not limited. Thus, any structures which are capable of preventing the high pressure water 31*a* from scattering in the periphery can be employed as the enclosing member 40. The structure may be optionally changed according to operating conditions.

In the first embodiment, the plastic nets 42 are folded along the lower ends. The lower ends may be welded in the circumferential direction. With proper welding width, raveling plastic fibers of the plastic nets 42 can be prevented even if the lower ends of the plastic nets 42 are abraded, so that span of life of the plastic nets 42 can be longer.

When the arm 22 is located on the line connecting the rotary shaft 24 and the center roller 14, the plastic nets 42 are very close to the outer circumferential face of the center roller 14. Also, the high pressure water 31*a* is directed from the jet nozzle 31, which is arranged diagonally to cause the high pressure water 31*a* to head for the center roller 14, toward the lower end of the inner face of the plastic nets 42, so that the polishing cloth 12*a* including the part in the vicinity of the center roller 14 can be fully cleaned.

As described above, the outer circumferential faces of the work plates 16 contact the outer circumferential face of the center roller 14. Outer edges of the work pieces, e.g., semiconductor wafers 17, are 7 mm separated away from the outer edge of the work plate 16, so that they are about 7 mm separated away from the outer circuferential face of the center roller 14. Therefore, the part of the polishing cloth 12*a*, which is 7 mm away from the outer circumferential face of the center roller 14, polishes the bottom faces of the semiconductor wafers 17. In this manner, the abraded grains and the reaction products deposit in the part of the polishing cloth 12*a*, which is close to the outer edge of the center roller 14, but the conventional means cannot fully remove the abraded grains, etc. from this part of the polishing cloth 12*a*.

In the first embodiment, the outer edges of the semiconductor wafers 17 are 7 mm separated away from the outer edge of the work plate 16. The present invention can also be applied to the situation in which a distance between the outer edges of the semiconductor wafers 17 and the outer edge of the work plate 16 is less than 7 mm, etc.

FIG. 5 is a schematic view showing a sectional shape of a jet form of the high pressure water 31*a*.

In the present embodiment, an outlet of the jet nozzle 31 is designed to make the sectional shape of the jet form of the high pressure water 31*a* longer in the direction "B" of movement of the arm 22. The sectional shape of the jet form of the high pressure water 31*a* is shown in FIG. 5 as a black long ellipse. The outlet of the jet nozzle 31 is also formed into a long elliptic shape.

Since the jet form is formed into the long ellipse whose long axis is extended in the direction "B", the high pressure water 31*a* can be directed to one point on the polishing cloth 12*a* for a long time, so that the part in the vicinity of the center roller 14, which cannot be fully cleaned by the conventional means, can be fully cleaned.

The sectional shape of the jet form of the high pressure water 31*a* is not limited to the long ellipse, it may be a circle, etc.

In the first embodiment, as shown in FIG. 5, the jet form is formed into the long ellipse whose long axis is extended in the direction "B", so the plastic nets 42 and the holding member 41 are also long in the direction "B". In this case, corners of the plastic nets 42 and the holding member 41 are rounded, the plastic nets 42 and the holding member 41 are not interfered with by the center roller when the arm 22 is swung. In this manner, the plastic nets 42, the holding member 41 and the jet nozzle 31 can be moved further close to the center roller 14.

Preferably, an inclination angle of the jet nozzle 31, with respect to the vertical line from the polishing cloth 12*a*, is about 10°.

If the inclination angle is larger, energy of the high pressure water 31*a* colliding with the polishing cloth 12*a* is decreased.

If the angle of the jet nozzle 31 is changed between a first angle, at which the jet nozzle 31 is headed toward the center roller 14, and a second angle, at which the jet nozzle 31 is vertical with respect to the polishing cloth 12*a*, the polishing cloth 12*a* can be effectively cleaned.

To change the angle of the jet nozzle, the jet nozzle 31 is, for example, rotatably attached to a shaft and is moved between two points corresponding to the first and second angles by a cylinder unit or a motor.

When changing the angle of the jet nozzle 31, the sensor 34 detects the rotational angle of the arm 22, then the jet nozzle 31 is inclined to clean the periphery of the center roller 14 if the jet nozzle 31 is located near the center roller 14. On the other hand, the jet nozzle 31 is made vertical to the polishing cloth 12*a* if the jet nozzle 31 is located far from the center roller 14. With this control, the polishing cloth 12*a* can be efficiently cleaned.

The structure of the enclosing member 40 is not limited to the plastic nets 42. For example, a cylindrical brush which encloses the jet nozzle 31 may be employed as the enclosing member 40.

Figure 6:
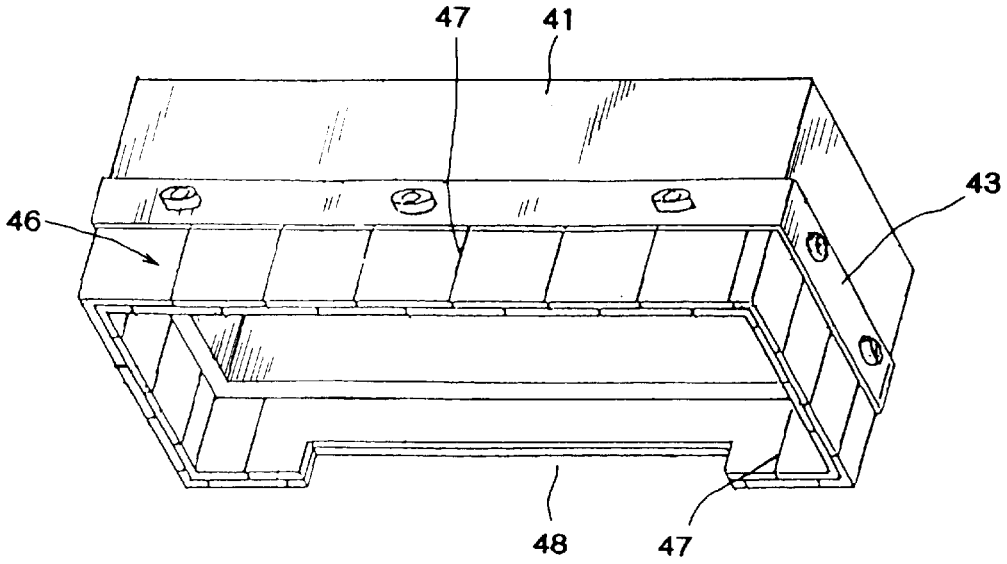
FIG. 6 is a perspective view of a plastic net of a second embodiment.

A second embodiment is shown in FIG. 6, which is a perspective view of another enclosing member.

In this embodiment, a plurality of pieces of curtain-shaped cloth 46, whose material is equal to that of the polishing cloth 12*a*, are fixed to the holding member 41 instead of the plastic nets 42. Inner cloth 46 and outer cloth 46, which are made of the same material and have the same size, are piled. They are sandwiched, by bolts, between the holding member 41 and the frame-shaped member 43.

Slits 47 of the inner cloth 46 and slits of the outer cloth 46 are not in correspondence with one another. In this manner, the entire curtain-shaped cloth 46 has an appropriate flexibility.

A passage 48 is formed in a lower end section of a rear part of the curtain-shaped cloth 46 so as to introduce the high pressure water outside.

The abraded grains and reaction products, which have been deposited in the polishing cloth 12*a*, are washed away by the high pressure water 31*a*. The water including the grains and the reaction products is introduced onto the polishing cloth 12*a* via the passage 48 and the slits 47.

Since the high pressure water directed from the nozzle 31 collides with the inner face of the curtain-shaped cloth 46, the pressure of the high pressure water is decreased, so that the water including the reaction products, etc. cannot be scattered to the periphery. The periphery can thus be kept clean.

The inner cloth 46 and the outer cloth 46 are made of the same material, so mutual abrasion can be prevented.

The passage 48 may be omitted. The number, size, etc. of each piece of the curtain-shaped cloth 46 may be optionally designed according to operating conditions, e.g., the pressure of the high pressure water.

Figure 7:
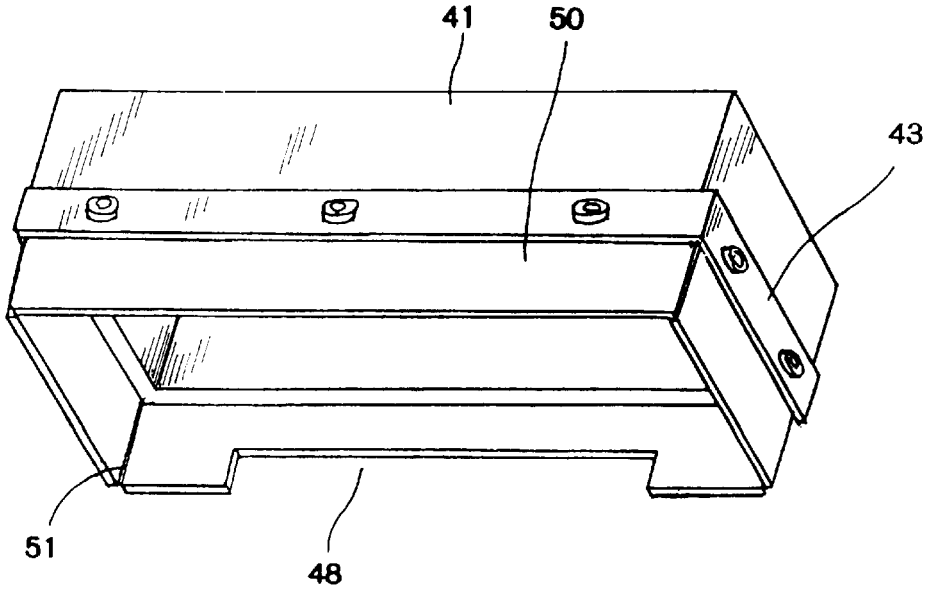
FIG. 7 is a perspective view of a plastic net of a third embodiment.

A third embodiment is shown in FIG. 7, which is a perspective view of another enclosing member.

In this embodiment, four pieces of curtain-shaped cloth 50, whose material is equal to that of the polishing cloth 12*a*, are fixed to the holding member 41 instead of the plastic nets 42. They are sandwiched, by bolts, between the holding member 41 and the frame-shaped member 43.

Each piece of the curtain-shaped cloth 50 is arranged on a respective side of the present enclosing member. Slits 51 are respectively formed at corners so that the curtain-shaped cloth 50 has proper flexibility. The passage 48 is formed in a lower end section of a rear part of the curtain-shaped cloth 50 so as to introduce the high pressure water outside. The passage 48 may be omitted.

The action of the enclosing member of the third embodiment is almost equal to that of the second embodiment (FIG. 6), so an explanation thereof will be omitted.

In the above described embodiments, the jet nozzle 31 and the enclosing member 40 are moved by the arm 22. However, the present invention is not limited to the embodiments. Any other means which is capable of moving the jet nozzle 31 and the enclosing member 40 in a plane parallel to the polishing cloth 12*a*, between the first position, which is located above the polishing cloth 12*a*, and the second position, which is located outside of the polishing cloth 12*a*, can be employed instead of the arm 22.

For example, an elongated arm, which is linearly and reciprocally moved, may be employed instead of the arm 22. The elongated arm may be moved linearly along a linear guide, which is arranged outside of the polishing plate 12 and guides the elongated arm in the radial direction of the polishing plate 12, so as to move close to and away from the center roller 14. The elongated arm may be driven by, for example, a driving mechanism including a ball screw or a chain-sprocket unit and a servo motor. By using the servo motor, the elongated arm can be positioned at the first and the second positions.

When employing the elongated arm, the jet nozzle 31 can be properly moved close to the center roller 14 as well as the swing able arm 22. Further, if the jet nozzle 31 is inclined and the lower end of the jet nozzle 31 is oriented toward the center roller 14, the high pressure water can be directed toward the part of the polishing cloth 12*a* which is in the vicinity of the center roller 14 so that the polishing cloth 12*a* can be properly cleaned.

In the above described embodiments, the semiconductor wafers 17 are polished as the work pieces. The work pieces are, of course, not limited to the semiconductor wafers.

In the cloth cleaning device and the polishing machine of the present invention, the polishing cloth including the part in the vicinity of the center roller can be fully cleaned, so that the work piece can be precisely polished with higher polishing efficiency and span of life of the expensive polishing cloth can be made longer.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A polishing machine including a polishing plate having an upper face covered with a polishing cloth, a driving mechanism for rotating said polishing plate, a center roller arranged in a center of and above the polishing plate, a work plate arranged over said polishing cloth and on which a work piece to be polished is adhered and whose outer circumferential face contacts an outer circumferential face of said center roller such that the work piece contacts the polishing cloth, a press head for pressing the work plate onto the polishing "cloth, a slurry feeding mechanism for feeding slurry to the polishing cloth, and a cloth cleaning device, the cloth cleaning device comprising:"

an arm movable in a plane parallel to the polishing cloth between a first position above the polishing cloth and a second position outside of the polishing cloth;

a jet nozzle attached to said arm for directing high pressure water toward the polishing cloth; and an enclosing member enclosing said jet nozzle to prevent the high pressure water directed out from said jet nozzle from scattering, said jet nozzle being oriented toward the center roller such that the high pressure water is directed toward a part of the polishing cloth in the vicinity of the center roller when said arm moves said jet nozzle close to the center roller.

2. The cloth cleaning device according to claim 1, wherein said jet nozzle has an adjustable angle relative to the polishing cloth such that said jet nozzle is adjustable between a first angle at which said jet nozzle is oriented toward the center roller and a second angle at which said jet nozzle is vertical with respect to the polishing cloth.

3. The cloth cleaning device according to claim 1, wherein said jet nozzle is structured and arranged to provide the high pressure water in a jet form having a sectional shape which is longer in a direction of movement of said arm.

4. The cloth cleaning device according to claim 1, wherein said enclosing member comprises a plastic net enclosing said jet nozzle.

5. A polishing machine, comprising:

a polishing plate having an upper face covered with a polishing cloth;

a driving mechanism for rotating said polishing plate;

a center roller arranged in a center of and above said polishing plate;

a work plate arranged over said polishing cloth and to which a work piece to be polished is adhered and whose outer circumferential face contacts an outer circumferential face of said center roller such that the work piece contacts said polishing cloth;

a press head for pressing said work plate against said polishing cloth;

a slurry feeding mechanism for feeding slurry to said polishing cloth;

an arm movable in a plane parallel to said polishing cloth between a first position above said polishing cloth and a second position outside of said polishing cloth;

a jet nozzle attached to said arm and arranged to direct high pressure water toward said polishing cloth; and an enclosing member enclosing said jet nozzle to prevent the high pressure water directed out from said jet nozzle from scattering, said jet nozzle being directable toward said center roller such that the high pressure water is directed toward a part of said polishing cloth in the vicinity of said center roller when said arm moves said jet nozzle close to said center roller.

6. The polishing machine according to claim 5, further comprising a guide roller arranged in the vicinity of an outer edge of said polishing plate, wherein an outer circumferential face of said work plate contacts outer circumferential faces of said center roller and said guide roller.

7. The polishing machine according to claim 5, wherein said jet nozzle has an adjustable angle relative to said polishing cloth such that said jet nozzle is adjustable between a first angle, at which said jet nozzle is oriented toward said center roller, and a second angle, at which said jet nozzle is vertical with respect to said polishing cloth.

8. The polishing machine according to claim 5, wherein said jet nozzle is structured and arranged to provide the high pressure water in a jet form having a sectional shape which is longer in a direction of movement of said arm.

9. The polishing machine according to claim 5, wherein said enclosing member comprises a plastic net enclosing said jet nozzle.

10. The polishing machine according to claim 5, further comprising:

a rotary shaft, said arm being fixed to said rotary shaft to enable rotation of said arm upon rotation of said rotary shaft; and driving means for rotating said rotary shaft.

11. The polishing machine according to claim 5, further comprising a plurality of additional work plates arranged over said polishing plate and to each of which a work piece to be polished is adhered, an outer circumferential surface of each of said additional work plates being arranged to contact the outer circumferential face of said center roller such that said center roller is arranged in a middle of said work plates.

12. The polishing machine according to claim 10, further comprising a sensor coupled to said rotary shaft for detecting a rotational angle of said rotary shaft.

13. The polishing machine according to claim 5, further comprising a holder box attached to said arm, said jet nozzle being coupled to and arranged at least partially within said holder box.

14. The polishing machine according to claim 13, further comprising a hood coupled to said holder box, said enclosing member being connected to said hood.

15. The polishing machine according to claim 14, further comprising a holding member connected to said hood, said enclosing member being connected to said holding member.

16. The polishing machine according to claim 15, further comprising a frame-shaped member, said enclosing member being held between said frame-shaped member and said holding member.

17. The polishing machine according to claim 5, wherein said enclosing member comprises a pair of folded plastic nets with a fold line being adapted to be situated more proximate to the polishing cloth.

18. The polishing machine according to claim 5, wherein said enclosing member comprises a double layer of curtain-shaped cloth pieces, a passage being formed in a lower end section of said cloth pieces along one side of said cloth pieces.

19. The polishing machine according to claim 5, wherein said enclosing member has a plurality of sides and comprises a single piece of curtain-shaped cloth extending along each side, a passage being formed in one of said cloth pieces along one side of said enclosing member.

20. The polishing machine according to claim 5, wherein said enclosing member is arranged relative to said polishing cloth such that a gap is present between said enclosing member and said polishing cloth through which high pressure water is introduced onto said polishing cloth.

* * * * *